US005345898A

United States Patent [19]

Krebs

[11] Patent Number: 5,345,898

[45] Date of Patent: Sep. 13, 1994

[54] VALVE OPERATING MECHANISM FOR AN INTERNAL-COMBUSTION ENGINE

[75] Inventor: Winfried Krebs, Ludwigsburg, Fed. Rep. of Germany

[73] Assignee: Dr. Ing. h.c.F. Porsche AG, Fed. Rep. of Germany

[21] Appl. No.: 112,328

[22] Filed: Aug. 27, 1993

[30] Foreign Application Priority Data

Aug. 29, 1992 [DE] Fed. Rep. of Germany ..... 4228796

[51] Int. Cl.[5] ..... F01L 1/34

[52] U.S. Cl. ..... 123/90.17; 123/90.6; 74/568 R

[58] Field of Search ..... 123/90.15, 90.16, 90.17, 123/90.6; 74/567, 568 R

[56] References Cited

U.S. PATENT DOCUMENTS

| | | | |
|---|---|---|---|
| 4,658,780 | 4/1987 | Hosoi | 123/90.22 |
| 4,794,893 | 1/1989 | Masuda et al. | 123/90.17 |
| 4,886,022 | 12/1989 | Nakai | 123/90.17 |
| 4,926,804 | 5/1990 | Fukuo | 123/90.17 |
| 5,143,031 | 9/1992 | Bruestle | 123/90.16 |
| 5,253,621 | 10/1993 | Dopson et al. | 123/90.17 |

FOREIGN PATENT DOCUMENTS

| | | | |
|---|---|---|---|
| 406026 | 1/1991 | European Pat. Off. | 123/90.17 |
| 0267687 | 1/1992 | European Pat. Off. . | |
| 3732687 | 4/1988 | Fed. Rep. of Germany . | |
| 4039256 | 5/1988 | Fed. Rep. of Germany . | |
| 208505 | 8/1989 | Japan | 123/90.17 |
| 277913 | 11/1990 | Japan | 123/90.17 |

OTHER PUBLICATIONS

Patent Abstracts of Japan, vol. 11, No. 352; (M-643)(2799) Nov. 18, 1987; JP-A-62 131 907 (Mazda).

Patent Abstracts of Japan, vol. 15, No. 19052; (M-113) May 16, 1991; JP-A-03 047 416 (Mitsubishi).

*Primary Examiner*—E. Rollins Cross
*Assistant Examiner*—Weilun Lo

[57] ABSTRACT

A valve operating mechanism for an internal combustion engine is disclosed which includes a camshaft arranged in the cylinder head of an internal-combustion engine. A center shift cam is provided which can be selectively connected in a form-locking manner to be rotated on the camshaft or to be rotatable with respect to the cam shaft. On each side of the shift cam, one fixed cam is provided each of which is non-rotatably connected with the camshaft. In the full-load operation of the internal-combustion engine, an electronic control guides by way of a lock valve pressure oil into a hydraulic chamber of the fixed cam and in this case displaces pistons as well as a hollow piston to thereby connect the shift cam with one of the fixed cams. The form-lockingly coupled shift cam actuates intake valves by a relatively large lift by way of a tappet. In the partial-load operation, while the oil pressure is disconnected, the fixed cams actuate the tappet by a smaller lift.

6 Claims, 3 Drawing Sheets

VALVE OPERATING MECHANISM FOR AN INTERNAL-COMBUSTION ENGINE

BACKGROUND AND SUMMARY OF THE INVENTION

This invention relates to a valve operating mechanism for an internal-combustion.

It is known to operate charge cycle valves of an internal-combustion engine in a variable manner, that is, with different valve timing and/or lifts. In European Patent Document EP-0 267 687 B1, a valve operating mechanism is disclosed in the case of which two intake valves are operated by means of a camshaft provided with different cams with the insertion of transmission elements constructed as rocker arms. Inside the rocker arms, axially displaceable pistons are disposed which, depending on their position, couple the rocker arms with one another in a form-locking manner. When the piston has moved out, a cam with a large valve lift will actuate the valves by way of two outer rocker arms which are coupled to a center rocker arm. When the piston has moved in, the center rocker arm is uncoupled, and the valves are actuated by way of the outer rocker arms by means of cams with a smaller valve lift.

An arrangement of this type requires a lot of space and is heavy because, in addition to the camshaft, additional shafts are arranged for the bearing of the rocker arms.

It is an object of the invention to simplify an arrangement of the above-mentioned type in a space-saving manner.

This object is achieved by means of an arrangement wherein the transmission elements are formed by the cams with at least one fixed cam non-rotatably connected with the camshaft and at least one rotational cam rotationally arranged on the camshaft and serving as a shift cam. In this valve operating mechanism, the cams are constructed as transmission elements. The construction is compact and one cam is non-rotatably arranged on the camshaft and the other cam is rotatably arranged on the camshaft. The cams act directly upon the valves, and according to the position of the pistons, the non-rotatably arranged or the form-lockingly coupled rotatable cam selectively act upon the valve.

As a result of the design of the cams, which at the same time serve as transmission elements, no rocker arm shafts or the like are required. The space requirement corresponds to a conventional valve operating mechanism in the case of which the cams act directly upon the valves.

By means of one preferred embodiment with the arrangement of three cams situated next to one another on the camshaft, of which the center cam or the two outer cams may be connected or disconnected, the charge cycle valves may be operated by means of different cam profiles.

When the center cam can be connected and is provided with a larger lift, for example, two valves actuated by way of a common tappet are operated in the upper load range of the internal-combustion engine in such a manner that an improved charge cycle will take place.

An arrangement of three cams with an identical lift but with different profile dimensions makes it possible to provide, for example, a shift cam arranged in the center with a course of the valve lift that is optimal for the partial-load range. In order to reduce the occurring friction losses, the shift cam may in this case run up on a roller integrated in the tappet. The center arrangement of a fixed cam with a smaller lift permits a position of the shift cams connected at high rotational speeds which is advantageous for the tappet with respect to stress.

Other objects, advantages and novel features of the present invention will become apparent from the following detailed description of the invention when considered in conjunction with the accompanying drawings.

DETAILED DESCRIPTION OF THE DRAWINGS

Figure 1:
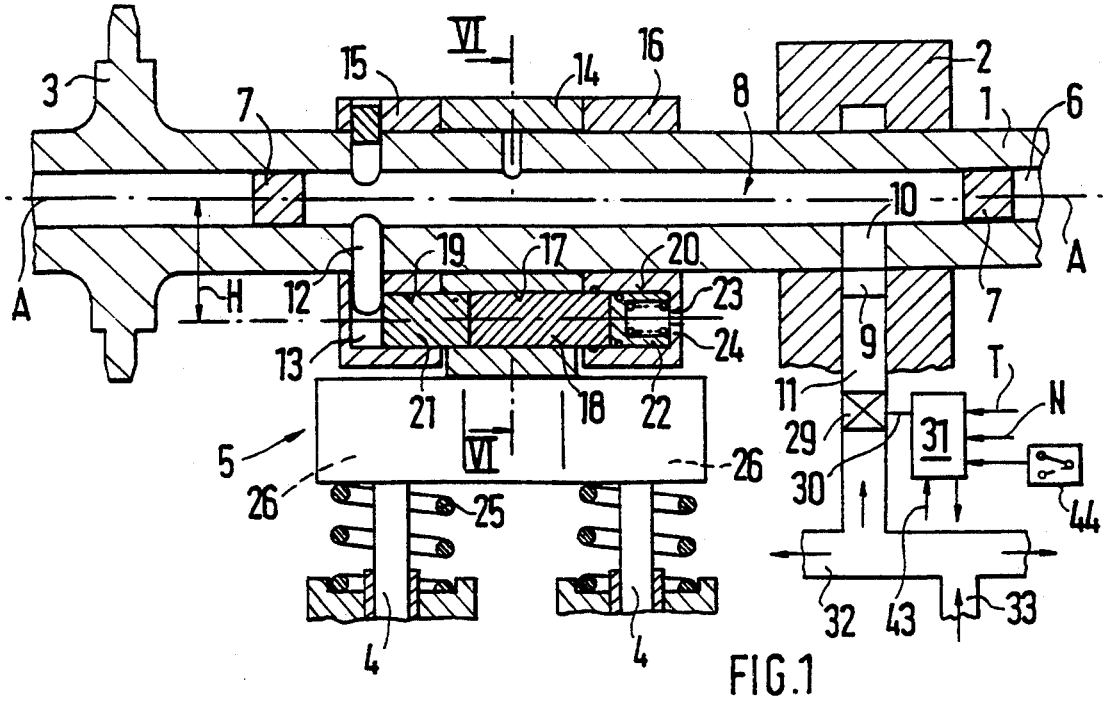
FIG. 1 is a schematic sectional view of a first embodiment of a valve actuating mechanism constructed according to the invention.

In a cylinder head of an internal-combustion engine which is not shown, a camshaft 1 is held in bearings 2 and is driven by way of a sprocket wheel 3 by a crankshaft which is not shown.

The camshaft 1 carries several cams which are used as transmission elements between the camshaft and intake valves 4 with the insertion of a tappet 5.

The camshaft 1 has a central bore 6 in which a section 8 is bounded by stoppers 7.

A groove 9, which is fed by way of a pressure oil pipe 11 and is connected with the central bore 6 by way of a radial bore 10, is cut into a bearing 2 situated within section 8. In the area of the cams, a radial bore 12 is arranged which intersects the central bore 6 and leads into a cylindrical hydraulic chamber 13 of a cam.

In a first embodiment according to FIG. 1, a first center cam is rotatably disposed on the camshaft 1 and is constructed as a shift cam 14. On both sides of shift cam 14, second and third cams 15 and 16 are non-rotatably arranged as fixed cams.

In the area of its maximal radial elevation, the shift cam 14 has a passage bore 17 in which a piston 18 is disposed in an axially displaceable manner. Both fixed cams 15, 16 have bores 19, 20 which correspond to the passage bore 17. Radial bore 12 leads into bore 19, and another displaceable piston 21 is disposed in it. Bore 20 has a spring-loaded hollow piston 22 whose spring 23 is supported on a bottom 24 of the bore 20.

Bores 19 and 20 as well as passage bore 17 have an identical distance H to the longitudinal axis A—A of the camshaft 1, and the pistons 18, 21 and the hollow piston 22 have an identical diameter D. The maximal lift of the fixed cams 15, 16 is less than that of the shift cam 14.

All cams act upon the tappet 5 which, being constructed in one piece, actuates both valves 4 simultaneously. In this case, a conventional valve spring 25 as well as a hydraulic valve clearance compensating element 26 integrated into the tappet 5 is assigned to each valve 4.

A lock valve 29 is arranged in the pressure oil pipe 11 and is opened or shut by way of a line 30 by an electronic control 31. This control 31 receives, among others, signals which correspond to the actual values of the oil temperature T and of the rotational speed N of the internal-combustion engine. The pressure oil pipe 11 is connected to a distributing pipe 32 which is connected by way of additional pressure oil pipes 11 with all cylinders of the internal-combustion engine and is fed with pressure oil by way of an inlet 33.

In the partial-load operation of the internal-combustion engine, the lock valve 29 is closed; there is no oil pressure in the hydraulic chamber 13. As a result, the spring 23 of the hollow piston 22 pushes the pistons 18 and 21 completely into the pertaining shift cam 14 or fixed cam 15. The shift cam 14 is uncoupled and the camshaft 1 rotates freely in this cam 14. The fixed cams 15 and 16 run synchronously onto the tappet 5 and actuate the intake valves 4 with a relatively small lift. When a defined load condition of the internal-combustion engine is exceeded, the lock valve 29 is opened and the annularly surrounding groove 9 is continuously fed by way of the bore 10 from the pressure oil pipe 11. The oil pressure, which acts upon the piston 21, pushes this piston 21 against the shift cam 14. When an inlet ramp 34 is overrun which is situated in front of the passage bore 17 in the rotating direction, the piston 21 is partially pressed into this bore 17 and in the process pushes the piston 18 partially into bore 20, the hollow piston being displaced against the spring 23 until it comes to rest against the bottom 24. The form-lockingly coupled shift cam 14 rotates synchronously with the fixed cams 15, 16 and actuates the tappet 5 because of the larger lift.

Figure 2:
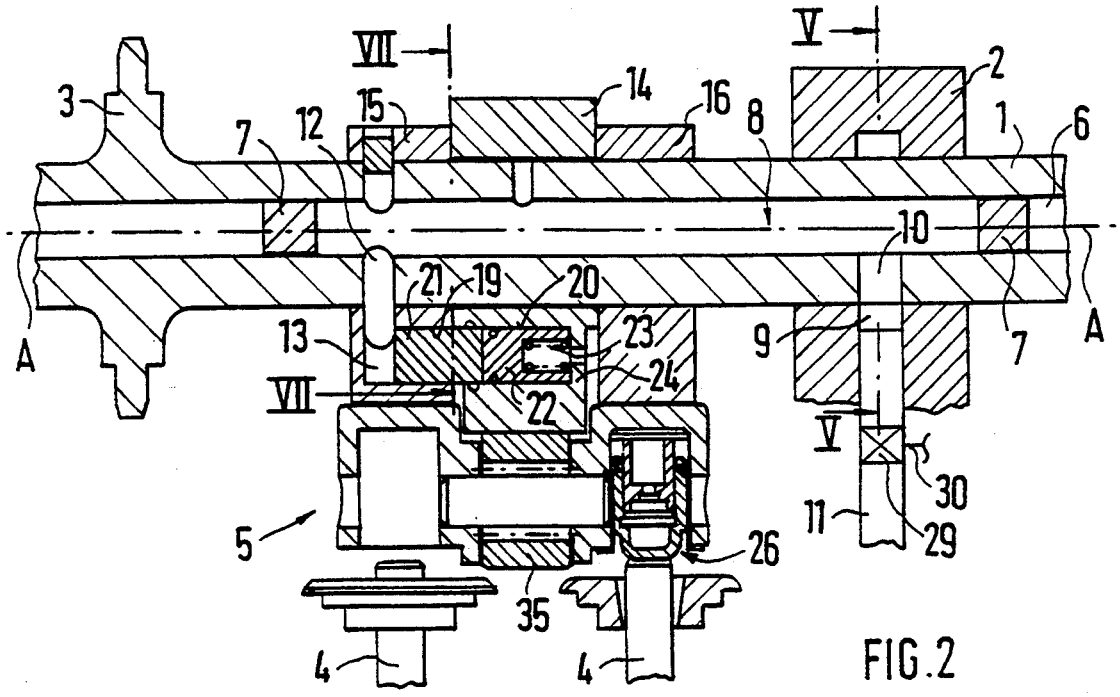
FIG. 2 is a schematic sectional view of a second embodiment of a valve actuating mechanism constructed according to the invention.

In a second embodiment of the invention according to FIG. 2, the coupling of the shift cam takes place only by way of a fixed cam 15 by means of the piston 21.

The tappet 5 is constructed as a roller tappet and will not be explained here in detail because it was described in German Patent Document DE-40 39 256 A1. In this case, for the partial-load operation of the internal-combustion engine, the center cam is provided with a different profile than the fixed cams 15, 16 and actuates the tappet in a low-friction manner by way of a roller 35, in which case lock valve 29 is open. All cams have an identical lift.

During a high load of the internal-combustion engine, the lock valve 29 will shut so that the shift cam 14 is disconnected and the tappet 5 is actuated by the fixed cams 15, 16. With respect to all other parts, this embodiment corresponds to that illustrated in FIG. 1.

Figure 3:
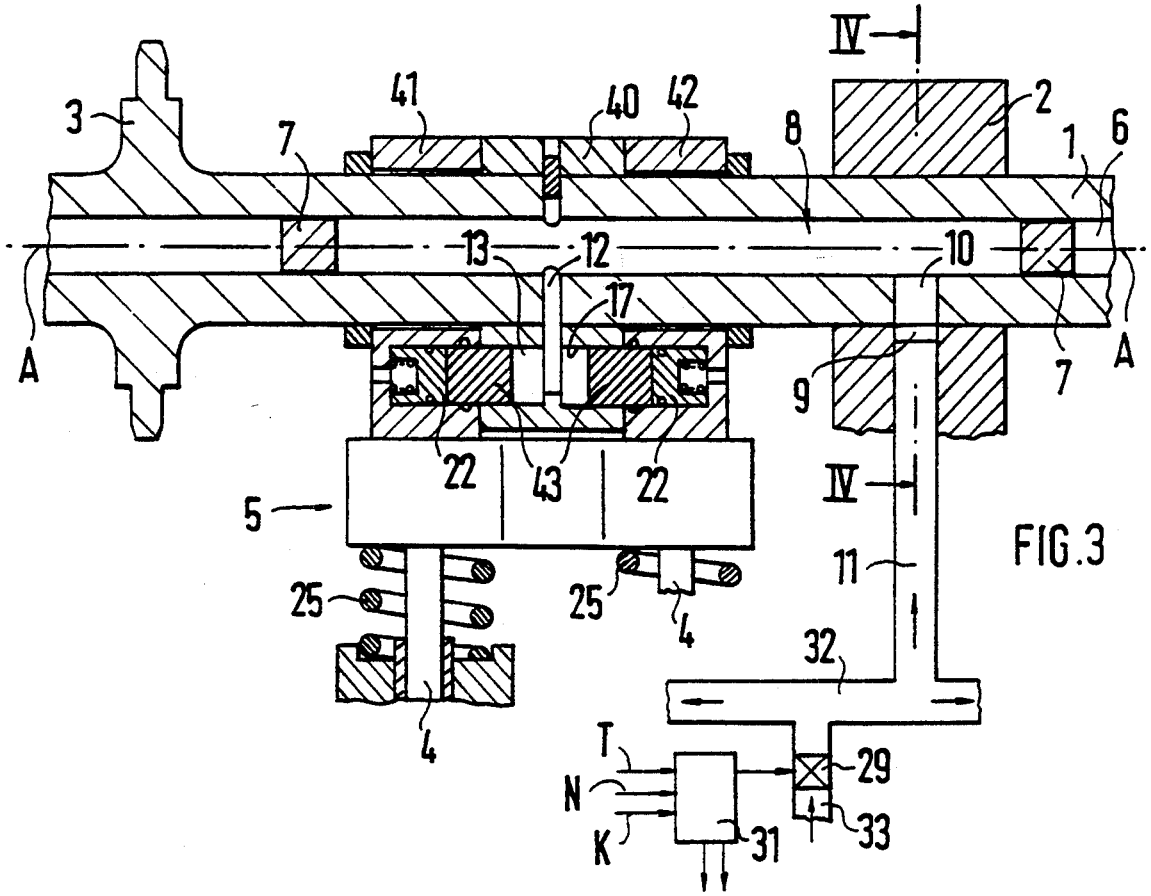
FIG. 3 is a schematic sectional view of a third embodiment of a valve actuating mechanism constructed according to the invention.
Figure 4:
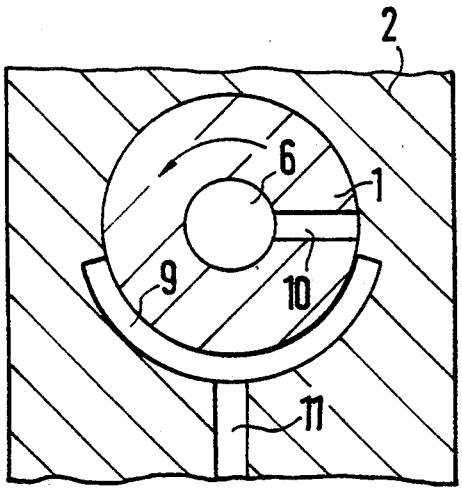
FIG. 4 is a sectional view along Line IV—IV according to FIG. 3.
Figure 5:
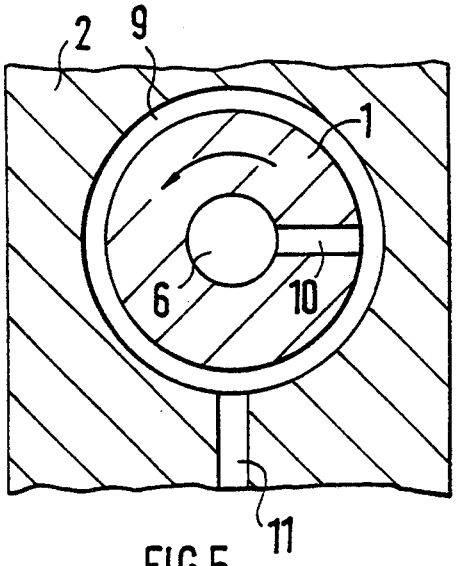
FIG. 5 is a sectional view along Line V—V according to FIG. 2.

A third embodiment of the invention according to FIG. 3 has a center cam constructed as a fixed cam 40 as well as, on both sides of it, one cam respectively constructed as a shift cam 41 and 42. The radial bore 12 extends in the center in the fixed cam 40 and leads centrally into the hydraulic chamber 13 formed between two opposed pistons 43 and the passage bore 19. The shift cams 41 and 42 each have a spring-loaded hollow piston 22.

In the bearing 2, a groove 9 is formed in the shape of a segment of a circle, and only one common lock valve 29 in the inlet 33 is assigned to all cylinders.

Provided with a smaller lift, the center cam is assigned to the partial-load range, while, when the load is increased and the lock valve 29 is open, the shift cams 41, 42 which are provided with a larger lift actuate the tappet 5 while they are connected in a form-locking manner.

In this case, both shift cams 41, 42 have an inlet ramp 34. The control 31 also processes a signal which corresponds to the actual throttle valve angle K.

In all embodiments of the invention, the coupling and the uncoupling of the shift cams takes place at least as a function of the rotational speed N of the internal-combustion engine. Also, additional parameters, such as the throttle valve angle K, may be fed to the control 31 as load information. The control 31 may also be designed adaptively. In this case, according to FIG. 1, by way of another input 43, for example, a signal concerning the time variation of the throttle valve angle K is detected as a measurement for the dynamics of the driving operation of a motor vehicle equipped with this valve operating mechanism. An intentionally quiet driving method without any jumps in dynamics in this case shifts the connecting of the cams equipped with the larger lift into economical rotational speed ranges of the internal-combustion engine. When the driving method is markedly sporty, the shifting is displaced into ranges which furnish optimal values with respect to the power and the torque.

As a modification, a switch 44 may be provided which is to be actuated manually and which permits a change-over between an economical and a sporty driving method according to fixed characteristic diagrams stored in the control 31. Values for the shifting of the shift cams as a function of the rotational speed N are read out of these characteristic diagrams.

Figure 6:
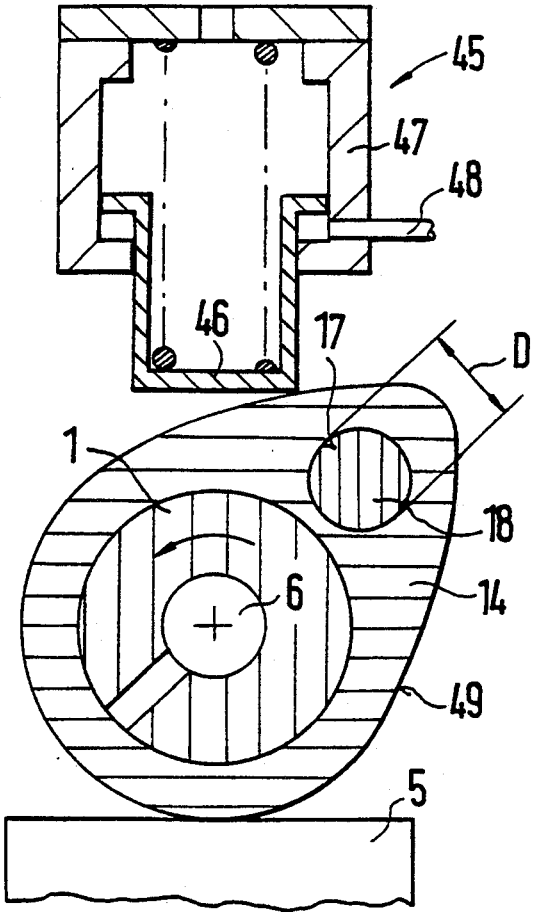
FIG. 6 is a sectional view along Line VI—VI according to FIG. 1 with a fixed shift cam.
Figure 7:
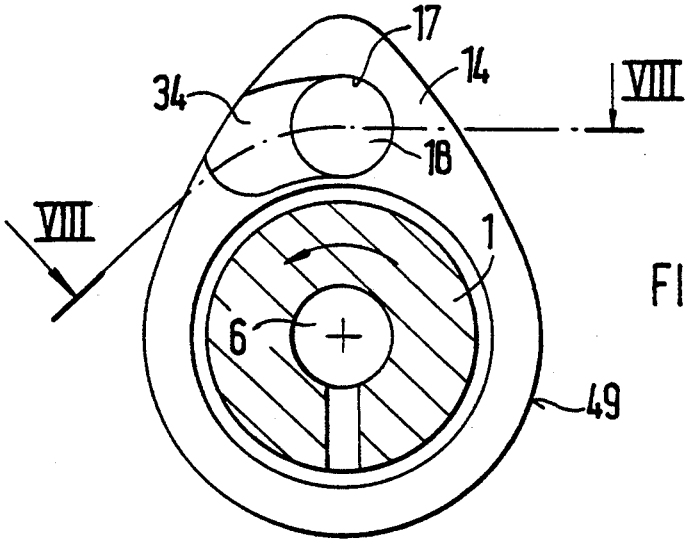
FIG. 7 is a sectional view along Line VII—VII according to FIG. 2.
Figure 8:
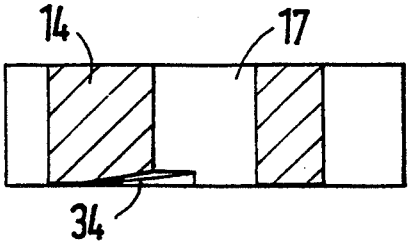
FIG. 8 is a sectional view along Line VIII—VIII according to FIG. 7.

In all embodiments, a hydraulically actuated fixing device 45 comprising a piston 46 is used for the fixing of the disconnected shift cams 14; 41, 42. This piston 46 is guided, according to FIG. 6, in a housing 47 held in the cylinder head and is moved out by way of a pressure line 48 when the shift cam 14; 41, 42 is disconnected. Thus, a defined position is provided when the pistons move into the inlet ramp 34 again and a sufficient time period is available for the form-locking connection. In this case, the position is selected in such a manner that, during the connecting, the shift cam runs onto the tappet 5 by means of its base circle 49.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A valve operating mechanism for an internal-combustion engine, comprising at least one cam shaft as well as as least two cams which are arranged on it and have different profiles for the actuating of charge cycle valves, these valves being actuated selectively by one or the other cam, transmission elements arranged between the cam shaft and the charge cycle valves are form-lockingly connectable with one another by means of axially displaceable pistons disposed in the transmission elements wherein the transmission elements are formed by the cams with at least one fixed cam non-rotatably connected with the cam shaft and at least one rotational cam arranged on the cam shaft and rotatable relative to the cam shaft and serving as a shift cam, wherein the at least one shift cam includes a shift cam arranged between two fixed cams wherein the maximal cam lift of the shift cam is larger than that of the fixed cams.

2. An operating mechanism according to claim 1, wherein a spring-loaded hollow piston is arranged in a bore of one fixed cam, which hollow piston, when the oil pressure is switched off, displaces a piston in a passage bore of the shift cam and this shift cam, in turn, displaces a piston in a bore of the other fixed cam.

3. A valve operating mechanism for an internal-combustion engine, comprising at least one cam shaft as well as as least two cams which are arranged on it and have different profiles for the actuating of charge cycle valves, these valves being actuated selectively by one or the other cam, transmission elements arranged between the cam shaft and the charge cycle valves are form-lockingly connectable with one another by means of axially displaceable pistons disposed in the transmission elements wherein the transmission elements are formed by the cams with at least one fixed cam non-rotatably connected with the cam shaft and at least one rotational cam arranged on the cam shaft and rotatable relative to the cam shaft and serving as a shift cam, wherein said at least one fixed cam includes a fixed cam arranged directly adjacent to said shift cam on the cam shaft, and wherein a piston is disposed in a hydraulic chamber of the fixed cam and is form-lockingly displaceable by means of oil pressure into a passage bore of the shift cam, wherein another fixed cam is arranged on the cam shaft directly adjacent to the shift cam in such a manner that the shift cam is situated in the center between the fixed cams.

4. An operating mechanism according to claim 3, wherein all cams provided with an identical lift act upon a common tappet.

5. A valve operating mechanism for an internal-combustion engine, comprising at least one cam shaft as well as as least two cams which are arranged on it and have different profiles for the actuating of charge cycle valves, these valves being actuated selectively by one or the other cam, transmission elements arranged between the cam shaft and the charge cycle valves are form-lockingly connectable with one another by means of axially displaceable pistons disposed in the transmission elements wherein the transmission elements are formed by the cams with at least one fixed cam non-rotatably connected with the cam shaft and at least one rotational cam arranged on the cam shaft and rotatable relative to the cam shaft and serving as a shift cam, wherein said at least one fixed cam includes a fixed cam arranged directly adjacent to said shift cam on the cam shaft, and wherein a piston is disposed in a hydraulic chamber of the fixed cam and is form-lockingly displaceable by means of oil pressure into a passage bore of the shift cam, wherein another shift cam is arranged on the cam shaft directly adjacent to the fixed cam in such a manner that the fixed cam is situated in the center between the shift cams.

6. An operating mechanism according to claim 5, wherein the fixed cam is provided with a smaller lift than the shift cam.

* * * * *